US005221002A

United States Patent [19]

Garganese

[11] Patent Number: 5,221,002

[45] Date of Patent: Jun. 22, 1993

[54] BEVERAGE CONTAINER CARRIER APPARATUS

[76] Inventor: Richard S. Garganese, 40 Celestia Ct., North Kingstown, R.I. 02852

[21] Appl. No.: 985,039

[22] Filed: Dec. 3, 1992

Related U.S. Application Data

[63] Continuation-in-part of Ser. No. 895,002, Jun. 8, 1992, abandoned.

[51] Int. Cl.[5] ..... B65D 75/00

[52] U.S. Cl. ..... 206/151; 206/145; 206/199; 294/87.2; 294/163; 294/169; 211/74

[58] Field of Search ..... 206/145, 150, 151, 192, 206/435, 427, 197, 199; 294/87.2, 163, 165, 169; 211/74, 80, 81; 220/23.4

[56] References Cited

U.S. PATENT DOCUMENTS

| | | | |
|---|---|---|---|
| 2,433,037 | 12/1947 | Ferris | 224/45 |
| 2,558,182 | 6/1951 | Killingsworth | 211/74 |
| 3,314,712 | 4/1967 | Hohl et al. | 294/87.2 |
| 3,870,115 | 3/1975 | Galloway | 211/74 |
| 3,935,977 | 2/1976 | Bonnett | 294/163 |
| 4,059,209 | 11/1977 | Grisel | 294/165 |
| 4,232,807 | 11/1980 | Beier et al. | 206/151 |
| 4,288,013 | 9/1981 | Napier | 206/145 |
| 4,651,873 | 3/1987 | Stoloenberg et al. | 206/142 |
| 4,798,286 | 1/1989 | Muscanelli | 206/150 |
| 5,018,620 | 5/1991 | Marco et al. | 206/150 |
| 5,038,892 | 8/1991 | Marco et al. | 206/162 |
| 5,050,755 | 9/1991 | Strawder | 220/23.4 |

FOREIGN PATENT DOCUMENTS

| | | | |
|---|---|---|---|
| 134694 | 3/1985 | European Pat. Off. | 206/145 |

*Primary Examiner*—David T. Fidei
*Attorney, Agent, or Firm*—Barlow & Barlow, Ltd.

[57] ABSTRACT

A beverage container carrier is shown formed from a single piece of rigid plastic material having two rows of container receiving apertures extending between a hinge end and a latch end. Separations are formed in the walls between apertures in each row and in the latch end in alignment with each row. A latch is formed in the latch end for each row of apertures. The longitudinal side portions are adapted, in the unlatched condition, to spring away from the center spine to receive containers and to snap back into a latched position to grip containers placed in the apertures.

20 Claims, 4 Drawing Sheets

BEVERAGE CONTAINER CARRIER APPARATUS

This is a continuation-in-part of Ser. No. 07/895,002 filed Jun. 8, 1992, now abandoned.

This invention relates generally to beverage containers and more specifically to carriers for holding and transporting a plurality of beverage containers.

It is well known to provide carriers for a plurality of identical cans or bottles in which apertures are formed in a resilient polymeric material such as low density polyethylene. Beverage containers are forced into respective apertures and are carried as a single unit. Examples of such carriers are shown in U.S. Pat. Nos. 3,314,712; 4,232,807; 4,651,873; 4,798,286; 5,018,620 and 5,038,928. These carriers are designed to be of low cost so that they can be discarded after the consumer has removed the containers from the carrier. While such carriers can be effective for their intended purpose, they have become a serious problem in the environment. The polymeric material is essentially too long lasting and such carriers have become ubiquitous in the environment causing life-threatening damage to fish and wildlife as well as being unsightly when discarded in the wild.

It is also known to provide a bottle carrier comprising first and second plates having a metal clip secured to an end of one plate and pivotally attached to an end of the other plate with matching semi-circular apertures and a latch member secured at the other end of the plates as shown in U.S. Pat. No. 2,433,037. While such bottle carriers are suitable for re-use, they are relatively expensive to provide since they are made of a plurality of parts which require assembly operations.

It is an object of the present invention to provide a beverage container carrier which is inexpensive yet which is particularly conducive for reuse. Another object is the provision of a carrier which can be easily loaded with a plurality of containers yet which will securely hold such containers until it is desired to remove one or more from the carrier.

Briefly, in accordance with the invention, a single piece of rigid plastic material is formed with first and second rows of beverage container apertures extending between a hinge end portion and a latch end portion of the carrier. The walls between the apertures in a row are formed with a separation, preferably in the form of a slanted wall or a tongue and groove so that the central or spine portion of the carrier enhances stability for the outer or longitudinal side portions of the carrier. A latch receiving recess is formed in the spine portion of the latch end portion and latch members extending from the longitudinal sides adjacent the latch end portion are adapted to move into and out of the latch receiving recess. According to a feature of the invention, the container receiving apertures are tapered so that they conform to metal containers having a rim which has a smaller diameter than the remainder of the container and in accordance with a second embodiment, the container receiving apertures are formed in a reduced wall thickness portion and are provided with recesses about their perimeters to provide a relatively flexible surface portion adapted to provide a gripping pressure to the containers. According to another feature of the invention, one or more tab portions extend laterally from one longitudinal side of a carrier adapted to be lockingly received in respective matching recesses in the other longitudinal side of another carrier. According to yet another feature of the invention, recesses are formed in the hinge end portion in communication with a container receiving aperture in each row to form a pair of hinges in the hinge end portion. According to a modified embodiment the container receiving apertures are formed with lead in recessed surface portions to facilitate alignment of the containers while loading the carrier. Another modification provides elliptical configurations for at least some of the container receiving apertures to equalize the holding force exerted on each container. In other modifications a plurality of relatively flexible fingers extend upwardly from the carrier around the periphery of each container receiving aperture and are angled inwardly. The fingers may all be of a single selected length adapted to fit under the rim of a container or may be of first and second lengths so that the shorter length is received under the rim of a container with the longer length extending over the rim of the container, in effect pinching the rim from above and below. A modified latch includes pins formed on either the spine or on each of the side portions and mating bores are formed in the other of the spine and side portions.

BRIEF DESCRIPTION OF THE DRAWINGS

The above mentioned and other features and objects of the invention will become more apparent and the invention will be better understood by reference to the following description of several preferred embodiments of the invention taken in conjunction with the accompanying drawings, wherein.

DESCRIPTION OF THE PREFERRED EMBODIMENTS

Figure 1:
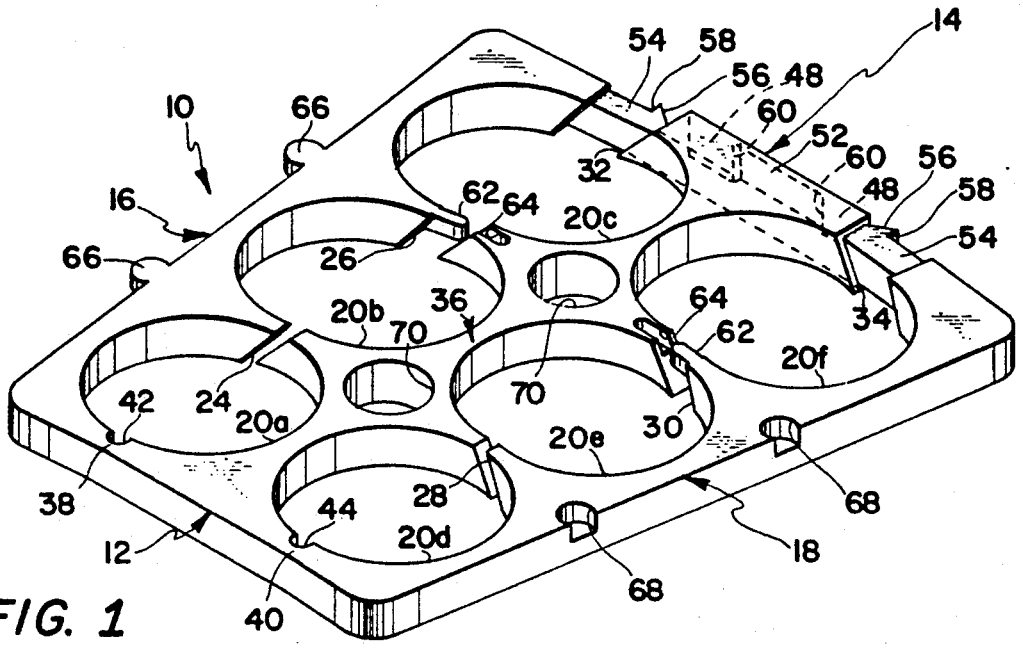
FIG. 1 is a perspective view of a first embodiment of a beverage container carrier made in accordance with the invention shown in the open, unlatched condition.

With reference to FIGS. 1–4, numeral 10 denotes a beverage container carrier made in accordance with a first embodiment of the invention. Carrier 10 is formed out of a single, rigid piece of material, such as a molded plastic material having a hinge end portion 12, a latch end portion 14, and longitudinal side portions 16, 18 respectively. First and second rows of apertures comprising apertures 20*a*, 20*b*, and 20*c* in one row and 20*d*, 20*e*, and 20*f* in the second row are formed in carrier 10 with separations 24, 26, 28 and 30 formed in the walls respectively between apertures 20*a* and 20*b*, 20*b* and 20*c*, 20*d* and 20*e* and 20*e* and 20*f*. Latch end portion 14 is also formed with separations 32, 34, in communication with respective apertures 20*c* and 20*f*, leaving a central spine 36 extending between end portions 12 and 14. Hinge portions 38 and 40 are formed in end portion 12 as by providing recesses 42, 44 in communication with apertures 20*a*, 20*d* respectively to form a hinge wall of selected thickness to permit longitudinal sides 16, 18 to be sprung apart. It will be understood that the hinges could also be formed by placing apertures 20*a*, 20*d* sufficiently close to end 12 to provide the selective wall thickness for the hinge portion.

Figure 3:
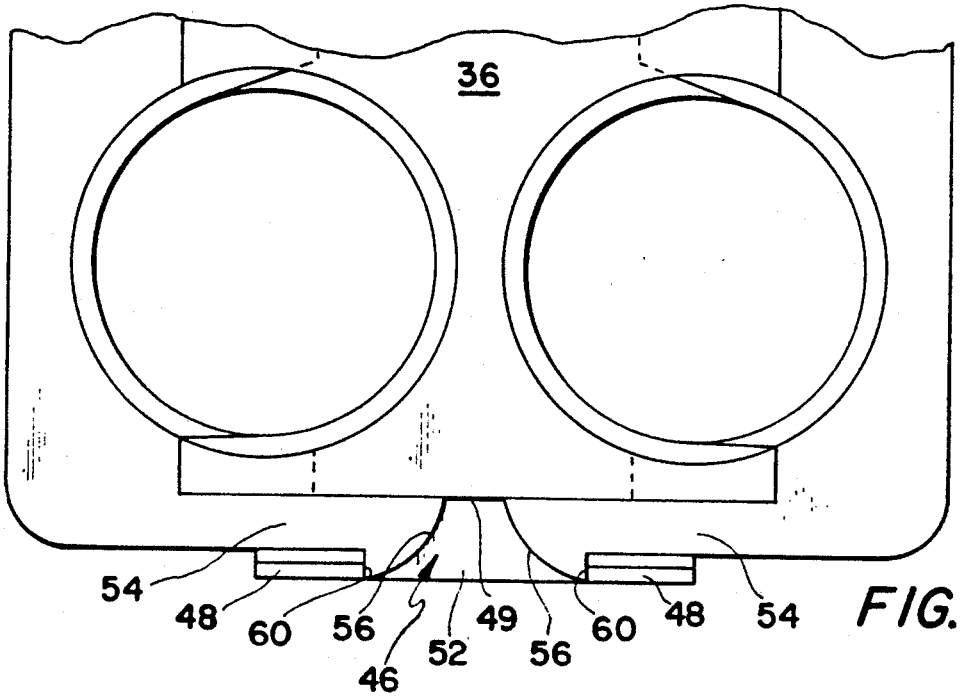
FIG. 3 is a bottom plan view of a portion of the carrier showing the latching mechanism in the closed, latched condition.

The latch end of spine 36 is formed with a latch receiving recess 46, see FIG. 3, defined by first and second wall portions 48 depending downwardly from a shelf 52. Latch members 54 extend from longitudinal side portion 16 and 18 and each has a cam surface 56 which tapers out to a latch surface 58 at a point which preferably provides a width slightly greater than the distance between walls 48 and wall 49 of spine 36 so that walls 48 need to be biased outwardly slightly to allow latch surfaces to pass beyond catch surface 60.

Preferably, in order to enhance stability of the carrier when in the latched condition, separations 24–34 are formed in such a way that the side portions 16 and 18 are adapted to transfer a force to the spine portion. Separations 24, 28 are slanted from the top surface of carrier 14 outwardly toward the side portions. Separations 26 and 30, in addition to the slant, are provided with a tongue and groove arrangement. As best seen in FIG. 1, a tongue 62 extends from the side portion towards spine 36 and is adapted to be received in a mating groove 64 formed in spine 36. Separations 32 and 34 are formed with slanted surfaces in the same manner as separations 24, 26 and in addition, the mating surfaces of catch surface 60 and latch surface 58 will also enhance stability. It will be understood that the separations between apertures 20*a* and 20*b* and between 20*d* and 20*e* could be formed in the same manner if desired. That is, the separations between the apertures could comprise merely slanted wall surfaces or they could all have a tongue and groove arrangement. For some applications a vertically extending separation could be adequate. In the illustrated arrangement, the degree of stability enhancement increases with increasing distance from hinge end 12 to match increasing stress.

Carrier 10 is also shown provided with a pair of locking tabs 66 extending outwardly from longitudinal side 16 configured in a suitable shape such as a portion of a circle but more than a semi-circle so that when received in matching recess 68 of an adjacent carrier, they will be locked together to facilitate carrying two or more carriers at a time. This arrangement is also useful in bulk storage of a number of loaded carriers. If desired, similar locking tabs and recesses can be provided on the hinge and latch-end end portions to permit locking carriers along their end portions as well as their side portions. In such cases it is preferable to place the recesses at the latch-end portion so that when carried, the additional force transmitted from a contiguous carrier will not be in an unlatching direction.

A pair of spaced apertures 70 are preferably provided in spine 36 for reception of a suitable handle or a person's fingers to facilitate carrying the apparatus. Other handle recesses can be provided as desired. For example, in an embodiment having locking tabs and recesses at the end portions described above, it may be desired to locate a recess at the end portions adjacent one or both sides to provide a balanced handle portion when carrying four interlocked carriers. Such recesses could be open at the end portion forming a hand receiving slot extending into contiguous interlocked carriers.

Figure 2:
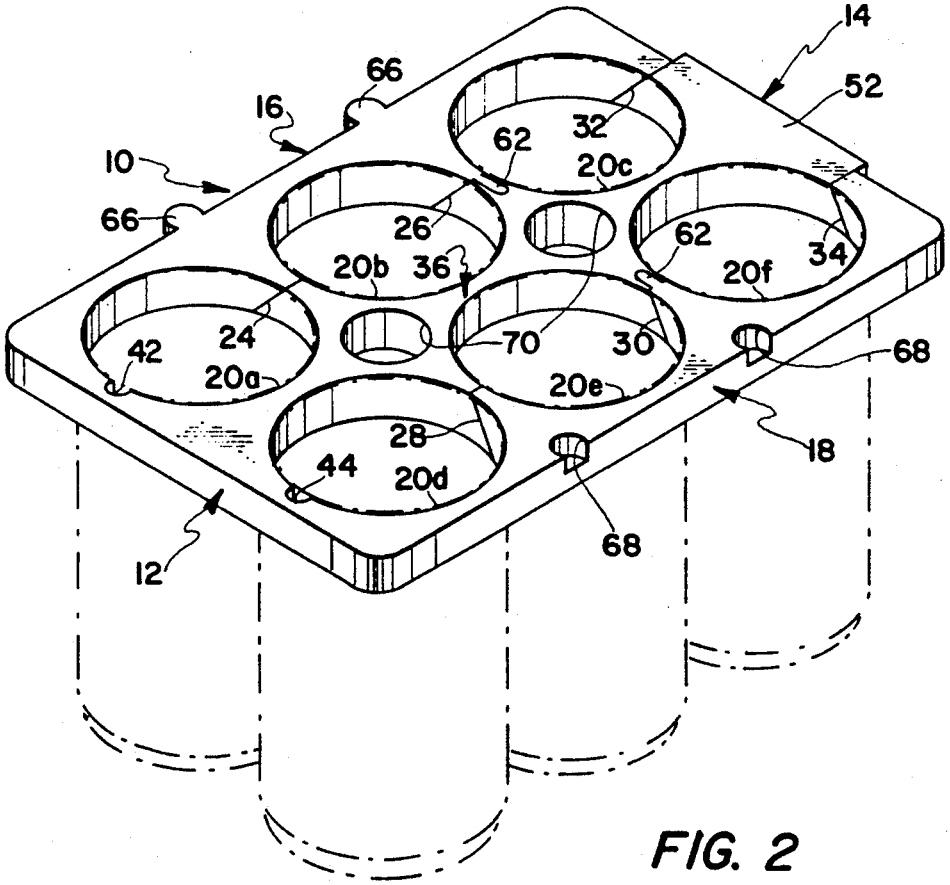
FIG. 2 is a view similar to FIG. 1 showing the carrier in the closed, latched position and showing in dash lines beverage containers held in the carrier.
Figure 4:
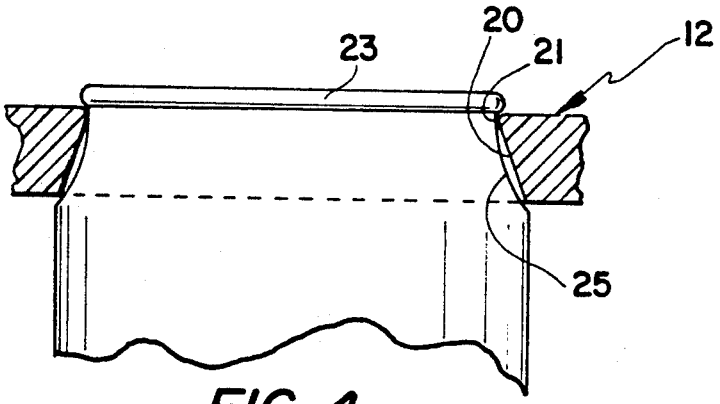
FIG. 4 is a sectional view taken through one of the apertures of the FIG. 1, 2 carrier shown with a portion of a conventional beverage can held in the aperture.

As noted in FIG. 4, aperture 20, which is a cross sectional view of one of the apertures 20*a*–20*f* of FIGS. 1, 2, is formed with a wall which increases in diameter from the top surface of the carrier to its bottom surface. This configuration, although not required for some container shapes, such as bottles having a large diameter collar adjacent their open end, is particularly useful for many metal cans which have a small lip 23 formed at the upper end of the can and then immediately adjacent thereto have a neck section 25 of increasing diameter. The outwardly flared bore 20 is adapted to have an upper edge 21 of the bore received under the lip 23 and still allow clearance for neck section 25 of the can. Although the tapered bore is shown in the figure as starting at the top surface, it will be understood that, if desired, the taper could begin a selected distance therefrom, e.g. 1/32 of an inch, to avoid having a sharp edge at 21.

Figure 5:
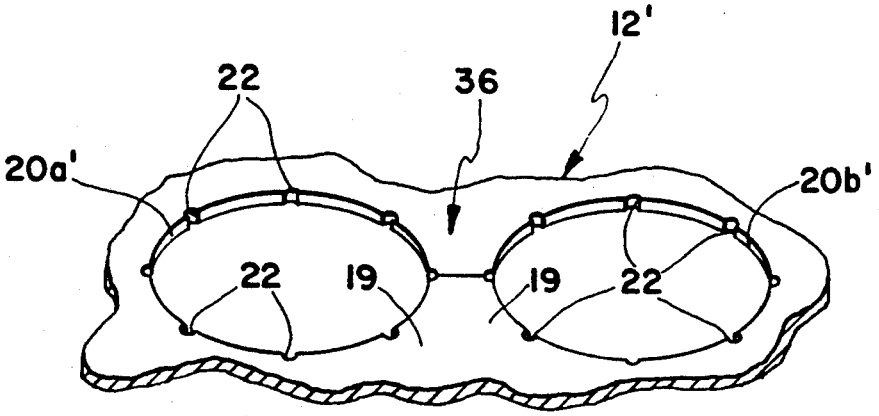
FIG. 5 is a perspective view of a broken away portion of a second embodiment of the invention.
Figure 6:
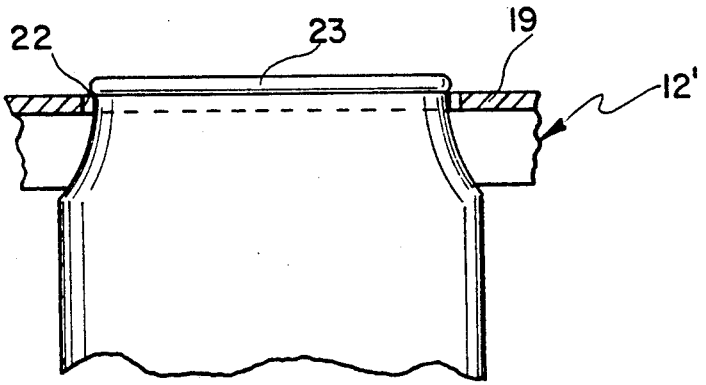
FIG. 6 is similar to FIG. 4 showing a section of the FIG. 5 embodiment.

With reference to FIGS. 5 and 6, an alternative embodiment is shown in which the carrier is formed with a wall 19 of reduced thickness surrounding each aperture, 20*a*′ and 20*b*′ shown in the figure. Preferably a series of recessed portions 22 are spaced about the bore of the apertures to provide a degree of flexibility which will allow the diameters of the bores to be selected so that there is a slight interference fit with the containers when the carrier is in the latched condition to provide a firm grasping of the containers.

Although a carrier made in accordance with the invention, if molded, would have an at rest open position with latch members 54 spaced apart from recess 46, it may be desired to place the carrier in the latched condition for convenience of storage and handling. When in the latched condition a carrier is placed in the open, container receiving condition by twisting downwardly and outwardly on the outer portions of latch end portion 14 which will allow latch surface 58 to move away from catch surface 60 with longitudinal side portions 16, 18 spreading apart from spine 26 about hinges 38, 40 respectively. The carrier is then placed over the upper portions of a plurality of cans and the latch members 54 reinserted into recess 46 to securely lock the containers to the carrier. When the containers are later removed, the carrier can then be reused. Such reuse can be encouraged, for example, by requiring a deposit for use of the carrier in much the same manner as is required for containers themselves in many geographical locations.

Figure 7:
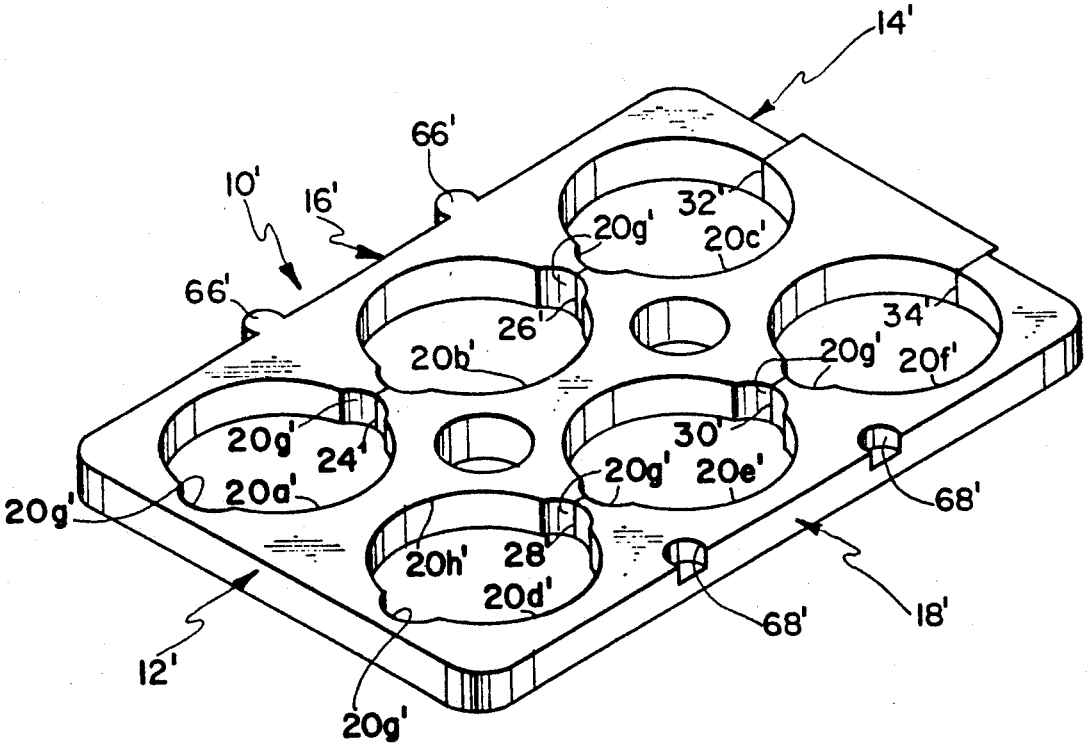
FIG. 7 is similar to FIG. 2 showing a modified embodiment.

FIG. 7 shows another modified embodiment in which the container receiving apertures of carrier 10′ are formed with lead in recessed surfaces to facilitate alignment of and insertion of containers. As shown in FIG. 7, recessed surface portions 20*g* are formed in the apertures in alignment with each row of apertures 20*a*′, 20*b*′, 20*c*′ and 20*d*′, 20*e*′ and 20*f*′. This is particularly useful with automatic loading apparatus wherein closing movement of side portions 16, 18 will result in engagement with a group of containers placed generally within the carrier and the surface portions 20*g* will cam the respective containers into proper aligned position with the respective apertures.

The container receiving apertures of FIG. 7 are also modified to provide at least selected ones with elliptical configurations with their major axis lying along a line generally parallel with the rows of apertures. This tends to compensate for a slight bowing of the carrier when in the latched condition holding a group of containers. The bowing effect is greatest in the central portion of the carrier, that is, midway between end portions 12 and 14 and apertures 20*b*' and 20*e*' are provided with a first elliptical configuration to compensate for this effect. Thus, the dimension of the length of the minor axis is chosen to be slightly less than the diameter of apertures 20*a*' and 20*d*', closest to the hinged end which are preferably maintained in a circular configuration. The apertures of the latched end portion 14 may also be formed in an elliptical configuration, preferably somewhat less than the centrally located apertures.

Although carrier 10' is shown as a generally solid block of material on which the apertures are formed, it will be understood that it may be formed with thinner walls reinforced with appropriate rib structures. In any event, the apertures are formed so that there is a clearance of at least a few degrees between the gripping edge 20*h* and the lower surface portion of the carrier relative to a container held in the aperture to facilitate loading of containers in the apertures as well as to provide clearance for the unloading motion, i.e. motion incident to removing a container from a latched carrier.

It will also be noted that in the FIG. 7 embodiment, the separations 24'-34' are formed so that they are generally vertical relative to the top and bottom surfaces of the carrier with the hinge and latch ends 12 and 14 providing sufficient support for the containers.

Figure 8:
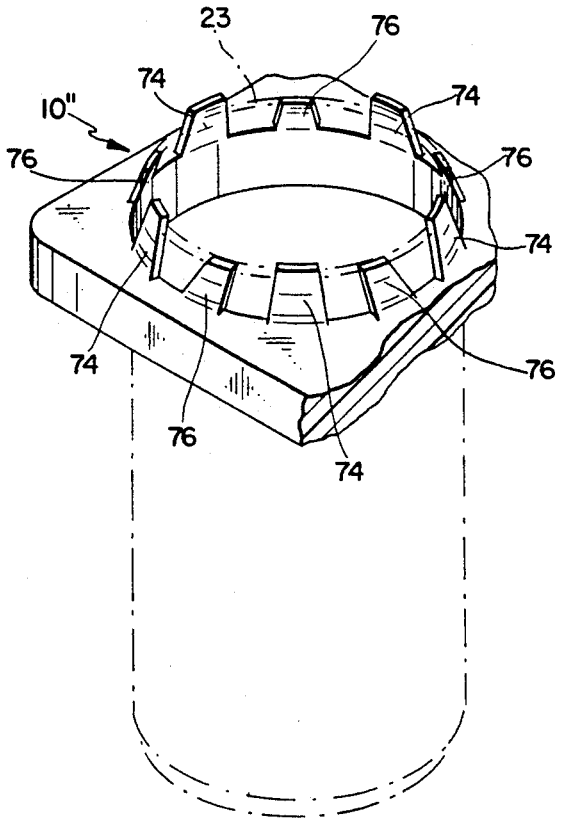
FIG. 8 is a perspective of a broken away portion of a modified carrier showing a plurality of fingers of first and second lengths formed around a container receiving aperture.

With reference to FIG. 8, a portion of a modified carrier 10'' is shown on which a plurality of flexible fingers of a first length 74 and a second length 76 extend upwardly from the carrier around the periphery of the container receiving aperture and are angled inwardly toward the center of the aperture.

Figure 8A:
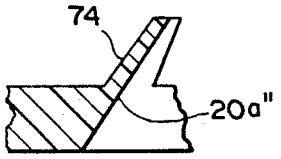
FIG. 8*a* is a cross sectional view taken through a finger of the FIG. 8 carrier.

In order to load the carrier it is latched closed and the carrier is forced down onto containers so that a rim 23 of a container pushes up on fingers 76 until the fingers snap beneath the rim with fingers 74 still biased against the top of the rim so that fingers 74, 76 cooperate to, in effect, pinch the rim around its periphery thereby securely locking the containers to the carrier. The walls defining the container receiving apertures are flared to provide clearance for the neck sections of the containers as seen in FIG. 8*a*.

Figure 9:
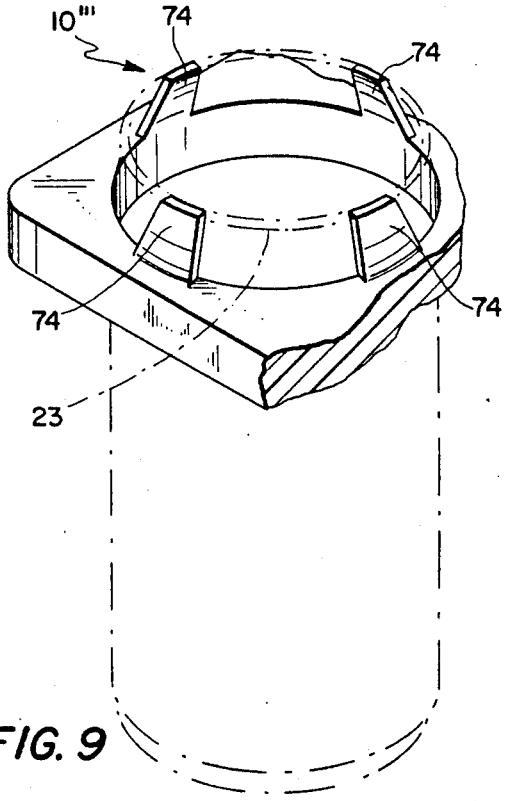
FIG. 9 is a view similar to FIG. 8 of another modified carrier showing a plurality of fingers of a single selected length formed around a container receiving aperture.

Carrier 10''' shown in FIG. 9 is similar to the carrier of FIG. 8, however, flexible fingers 74 of only one length are provided around the periphery of the container receiving aperture. In the FIG. 9 embodiment, the carrier in the latched condition is pushed down onto the containers until the ends of fingers 74 snap below rim 23 of the containers, again securely locking the containers to the carrier.

Figure 10:
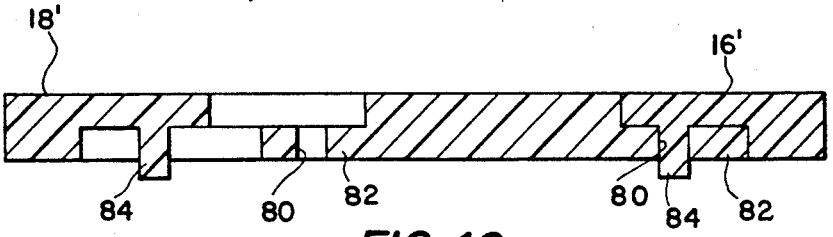
FIG. 10 is a cross sectional view of a modified latch for locking a carrier.

FIG. 10 shows a modified latching mechanism useful with the FIGS. 8 and 9 embodiments as well as with the embodiments of FIG. 1-7. In FIG. 10, the spine portion of the carrier is formed with first and second apertures 80 formed in tabs 82. Downwardly depending pegs 84 are formed on the latch end of each longitudinal side portion 16', 18', and are adapted to be received in a respective aperture 80 so that the spine portion supports the longitudinal side portions. Preferably pegs 84 are slightly longer than the width of tabs 82 to facilitate unlatching. It will be appreciated that the tabs, pegs and apertures could be reversed, if desired, with the spine still supporting the longitudinal side portions.

It will be appreciated that although the carrier is shown with six container receiving apertures, the particular number used is a matter of choice. Further, as mentioned above, the size of the apertures can be chosen to accommodate any selected can or bottle.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. A beverage container carrier comprising a single piece of rigid plastic material having a top and bottom surface and having first and second rows of container receiving apertures formed therethrough extending between first and second longitudinal side portions from a first hinge end portion to a second, opposite latch end portion of the carrier, the apertures of each row being defined by wall portions between respective apertures in the row, a separation formed in each wall portion between respective apertures in a row, a separation formed in the latch end portion of the carrier in alignment with each row of apertures, hinge means formed in the hinge end portion of the carrier in alignment with each row of apertures, and latch means formed in the latch end portion adapted to latch and unlatch the first and second longitudinal side portions to a central spine portion of the carrier, the longitudinal side portions being adapted to swing apart from the spine portion about the hinge means.

2. A beverage container carrier according to claim 1 in which said separations in the wall portions between respective apertures in a row includes a surface between the top and bottom surfaces inclined outwardly toward a respective longitudinal side portion from the top to the bottom surface.

3. A beverage container carrier according to claim 1 in which said separations in the wall portions between respective apertures in a row includes a groove formed in the central spine portion and a tongue formed in the longitudinal side portions adapted to be received in the groove when the carrier is in the latched condition.

4. A beverage container carrier according to claim 2 in which said separations in the wall portions between respective apertures in a row include a groove formed in the central spine portion and a tongue formed in the longitudinal side portions adapted to be received in the groove when the carrier is in the latched condition.

5. A beverage container carrier according to claim 1 in which the central spine portion of the latch end is formed with an outer wall defining a latch recess having an opening facing toward each longitudinal side portion of the carrier, a catch surface being formed in the outer wall within the recess and a latch member having a cam surface and a latch surface extending from each longitudinal side portion toward the latch recess, the cam surface being adapted to bias the outer wall sufficiently to allow the latch member to move into the recess until the latch surface passes beyond the catch surface.

6. A beverage container carrier according to claim 1 in which the container receiving apertures are formed with an outwardly extending taper in the direction going from the top surface to the bottom surface of the carrier.

7. A beverage container carrier according to claim 1 in which the container receiving apertures are formed in a reduced thickness wall portion of the carrier and a plurality of recesses extend between the top and bottom surface of the carrier in communication with each container receiving aperture to provide a relatively flexible container grasping surface.

8. A beverage container carrier according to claim 1 in which a recess extends between the top and bottom surface in the hinge end portion of the carrier in communication with a container receiving aperture in each row.

9. A beverage container carrier according to claim 1 in which at least one tab extends laterally outwardly from one of the longitudinal side portions and a recess conforming to the tab is formed in the other longitudinal side portion in alignment with each tab, the tab of one carrier adapted to be received in a recess of an adjacent similar carrier.

10. A beverage container carrier according to claim 9 in which the tab and recess configuration is generally a portion of a circle and comprising more than a semi-circle so that a tab when received in the respective recess is locked therein with respect to lateral forces.

11. A beverage container carrier according to claim 1 further including lead in surface means in communication with the apertures to facilitate alignment of containers to be inserted in the carrier.

12. A beverage container carrier according to claim 1 in which the container receiving apertures are generally circular.

13. A beverage container carrier according to claim 1 in which at least selected apertures are generally elliptical having a major axis extending parallel with their respective row of apertures.

14. A beverage container carrier according to claim 1 in which at least on tab extends laterally outwardly from one of the side and end portions and a recess conforming to the tab is formed in the other of the side and end portions in alignment with each tab, the tab of one carrier adapted to be received in a recess of an adjacent similar carrier.

15. A beverage container carrier according to claim 1 in which a plurality of flexible fingers extend from and are spaced around each container receiving aperture.

16. A beverage container carrier according to claim 15 in which the flexible fingers extend upwardly from the top surface and inwardly toward the center of their respective container receiving aperture.

17. A beverage container carrier according to claim 16 in which the flexible fingers are all of a single length.

18. A beverage container carrier according to claim 16 in which the flexible fingers are formed of first and second lengths, the fingers of the first length alternated with the fingers of the second length around each container-receiving aperture.

19. A beverage container carrier according to claim 15 in which the central spine portion of the latch is formed with a tab for each longitudinal side portion of the carrier and a peg receiving bore is formed through each tab from a top surface to a bottom surface and a downwardly extending peg is formed on each longitudinal side portion adapted to be received in a respective peg receiving bore.

20. A beverage container carrier according to claim 1 in which the central spine portion of the latch is formed with a tab for each longitudinal side portion of the carrier and a peg receiving bore is formed through each tab from a top surface to a bottom surface, and a downwardly extending peg is formed on each longitudinal side portion adapted to be received in a respective peg receiving bore.

* * * * *